US008498090B2

(12) United States Patent
Meid

(10) Patent No.: US 8,498,090 B2
(45) Date of Patent: Jul. 30, 2013

(54) APPARATUS AND METHOD FOR SUPPLYING POWER TO A VOLTAGE- OR CURRENT-RELEASING SWITCHING DEVICE

(75) Inventor: Wolfgang Meid, Muelheim-Kaerlich (DE)

(73) Assignee: Eaton Industries GmbH, Bonn (DE)

( * ) Notice: Subject to any disclaimer, the term of this patent is extended or adjusted under 35 U.S.C. 154(b) by 602 days.

(21) Appl. No.: 12/678,121

(22) PCT Filed: Aug. 21, 2008

(86) PCT No.: PCT/EP2008/006881

§ 371 (c)(1),
(2), (4) Date: Oct. 6, 2010

(87) PCT Pub. No.: WO2009/043412

PCT Pub. Date: Apr. 9, 2009

(65) Prior Publication Data

US 2011/0038092 A1 Feb. 17, 2011

(30) Foreign Application Priority Data

Sep. 27, 2007 (DE) ..... 10 2007 046 634

(51) Int. Cl.
*H01H 47/22* (2006.01)

(52) U.S. Cl.
USPC ..... 361/160

(58) Field of Classification Search
USPC ..... 361/160
See application file for complete search history.

(56) References Cited

U.S. PATENT DOCUMENTS

| | | | | |
|---|---|---|---|---|
| 5,930,104 | A | 7/1999 | Kadah et al. | |
| 6,246,562 | B1 | 6/2001 | Durif | |
| 6,671,158 | B1 | 12/2003 | Underwood | |
| 2002/0001204 | A1 * | 1/2002 | Lentini et al. | 363/21.06 |
| 2002/0021539 | A1 * | 2/2002 | Odaohhara et al. | 361/103 |
| 2003/0235059 | A1 * | 12/2003 | Perry | 363/21.06 |
| 2004/0257839 | A1 * | 12/2004 | Yang et al. | 363/21.12 |
| 2006/0262479 | A1 * | 11/2006 | Heaston | 361/160 |
| 2010/0289603 | A1 | 11/2010 | Meid | |

FOREIGN PATENT DOCUMENTS

| | | | |
|---|---|---|---|
| DE | 29909901 | U1 | 9/1999 |
| DE | 102007031995 | A1 | 1/2009 |
| EP | 1009003 | A1 | 6/2000 |
| EP | 1009003 | B1 | 1/2004 |

OTHER PUBLICATIONS

International Search Report for PCT/EP2008/006881 mailed on Oct. 29, 2008.

* cited by examiner

*Primary Examiner* — Stephen W Jackson
*Assistant Examiner* — Angela Brooks
(74) *Attorney, Agent, or Firm* — Leydig, Voit & Mayer, Ltd.

(57) ABSTRACT

A power supply for a voltage or current-releasing switching device having at least one coil for one of a voltage and current release includes a device which activates a switch means in a pulse-width modulated manner, the device configured for setting the current flowing in the coil, wherein inductance of the coil functions as an impedor of a clocked power supply which, via a rectifier diode and a storage capacitor, provides a first supply voltage that is predefinable via a comparison value. A voltage regulation device provides at least one second supply voltage. A measurement-resistor-free regulation device is provided for setting the current through the coil.

12 Claims, 1 Drawing Sheet

APPARATUS AND METHOD FOR SUPPLYING POWER TO A VOLTAGE- OR CURRENT-RELEASING SWITCHING DEVICE

CROSS-REFERENCE TO RELATED APPLICATIONS

This is a U.S. national phase application under 35 U.S.C. §371 of International Application No. PCT/EP2008/006881, filed Aug. 21, 2008, and claims benefit of priority under 35 U.S.C. §119 of German Application No. 10 2007 046 634.1, filed Sep. 27, 2007.

FIELD

The invention relates to an apparatus and a method for supplying power to a voltage- or current-releasing switching device comprising a voltage and current release having at least one coil, with a first supply voltage, the value of which is determined by a predefinable comparison value.

BACKGROUND

It is already described in EP 1 009 003 B1 to provide an arrangement with a control device comprising an electromagnet, the arrangement comprising at least one holding coil positioned in series with an electronic switch, connected to the terminals of a supply voltage of the coil, measuring means for measuring the holding current flowing in the holding coil, control means for actuating the electromagnet as well as means for supplying power to the control means. The means for supplying power to the control means are connected in series with the holding coil and the electronic switch so that they are supplied with holding current. The holding current measuring means comprise a measuring switch which is connected in parallel with the power supply means of the control means and has an additional electronic switch, and also comprise a measuring resistor connected in series therewith. The control means are connected to the terminals of the resistor and to a control electrode of the additional electronic switch, the additional electronic switch being switched into the conducting state at regular intervals. The power supply means comprise a Zener diode, connected in series with the coil and the electronic switch, and a further diode which is connected in series with a capacitor to the terminals of the Zener diode. The power supply means further comprise a diode connected in series with the Zener diode or a voltage regulation circuit connected in parallel with the capacitor. An auxiliary voltage supply regulation circuit is connected in parallel with a capacitor. The auxiliary supply voltage is supplied to a microprocessor. A second auxiliary supply voltage which is not regulated is the voltage for this capacitor. The passage of a regulated holding current through the coil is controlled by the microprocessor. At periodic intervals, the microprocessor acts simultaneously on two of the outputs thereof which each lead to a transistor, these transistors being connected to the supply circuit on the source side in one case and on the gate side in the other. The microprocessor sends control commands to the two transistors during the time required to measure the voltage at the resistor which is connected on the source side to one of the two transistors. The other transistor is connected on the gate side to a voltage adjustment circuit which in turn is positioned at one of the signal outputs of the microprocessor.

DE 299 09 901 U1 proposes an electronic drive control means for a contactor drive containing a drive coil and an armature. In order to provide drive control without controlling the coil current, an average actuation current of optimal size is produced by means of a respective pulse width of the drive coil within a wide static and dynamic range of a supply voltage with high dynamics provided by a rectifier circuit. This is achieved both during the pull-in and holding procedures. High dynamics are achieved from the pulse width control derived from the supply voltage alone by avoiding coil current measurement. The average actuation voltage should be virtually independent of the supply voltage and assume such a value that the armature is attracted with optimal closing dynamics and is held securely with minimal power. A microprocessor monitors the input voltage to ensure that it remains within a permissible voltage range and when it falls below or exceeds this range the contactor drive is prevented from switching on or, when this range is reached, the contactor drive is activated.

In EP 1 009 003 B1, the clocked transistor is connected or disconnected as a function of the current measured. Increased circuit complexity is therefore required to regulate the pull-in or holding current owing to the measuring resistor.

A pulse-width modulation operation is described in DE 10 2007 031 995.

SUMMARY

In an embodiment, a present invention provides a power supply for a voltage or current-releasing switching device including at least one coil for a voltage or current release. The power supply includes an activation device configured to activate a switch device in a pulse-width modulated manner, the activation device being configured for setting current through a coil, wherein inductance of the coil functions as an impedor of a clocked power supply configured to provide, via a rectifier diode and a storage capacitor, a first supply voltage that is predefinable via a comparison value. A voltage regulation device is provided for providing at least one second supply voltage. A measurement-resistor-free regulation device is provided for setting the current through the coil.

BRIEF DESCRIPTION OF THE DRAWINGS

For a clearer understanding of the invention, an embodiment thereof is described in greater detail below with reference to the drawings, in which.

DETAILED DESCRIPTION

Figure 1:
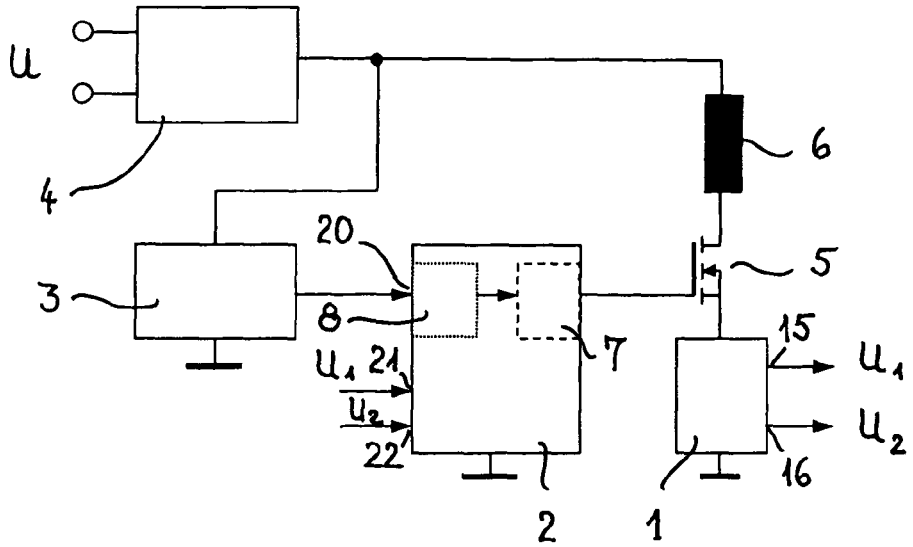
FIG. 1 is a schematic diagram of a power supply apparatus according to the invention, in combination with a control unit, a pulse-width modulation device and a coil for actuating a voltage or current release of a switching device.

Embodiments of the present invention provide an apparatus and a method for supplying power to a voltage- or current-releasing switching device comprising a coil of a voltage or current release, it being possible to dispense with the construction of a separate switch-mode power supply and in particular to dispense with the provision of a linear controller, said apparatus having a simpler construction than those in existence, in particular that of EP 1 009 003 B1.

In an embodiment, a pulse-width modulation device is provided for maintaining a pull-in current and a holding current of the coil actuating the voltage or current release, and the coil acts as an impedor of the apparatus serving as a power supply, the power being regulated without a measuring resistor. An embodiment of a voltage- or current-releasing switching device includes a coil of the voltage or current release that is provided as an impedor of the apparatus acting as a power supply. A pulse-width modulation device is provided for maintaining a pull-in or holding current of the coil. In an embodiment, a method for supplying power to a voltage- or current-releasing switching device is provided in that the coil is used as an impedor of a voltage supply apparatus acting as a power supply and the current flowing through the coil is used to generate the supply voltage of the switching device and is maintained over the supply voltage range by pulse-width modulation.

In this way, an apparatus and a method for supplying power, or a switching device comprising a power supply apparatus of this type are produced, in which it is no longer necessary to construct a separate power supply to guarantee power is supplied to a control unit. After a supply voltage has been applied, a plunger is pulled in the region of the at least one voltage or current release and is held in this new position. In the case of a voltage release, the switching device, in particular a power switch, may subsequently be switched on again. In this case, the plunger is not locked in the pulled-in position. In contrast, in the case of a current release, the switching device, in particular the power switch, is released when the supply voltage is applied and it is prevented from switching on again. The power supply apparatus which uses the coil actuating the voltage or current release as an impedor is used to power the control unit performing the activation operation instead of a separate power supply. It is possible to provide a single coil which acts as a pull-in or holding coil. It is further possible for at least two coils to be provided, one of which is a pull-in coil and the other is a holding coil. Only the term "coil" will be used below, but this should be understood to include both the above variants.

The current flowing through the coil is used to supply power to the control unit. On account of this current, it is possible for a voltage to be generated within the power supply apparatus and, above a predefinable threshold, this voltage can advantageously be used for supplying power to the control unit or the pulse-width modulation device. It is possible for the control unit to comprise the pulse-width modulation device or be connected before or after said device.

As is known, the current flowing through the coil of a voltage or current release is greater during the pull-in operation than in the holding state. However, by providing the pulse-width modulation device, the pull-in current and the holding current can be held constant, irrespective of the supply voltage. In this way, it is also possible for the power supply apparatus to be supplied with a current which is constant over the entire supply voltage range.

No shunts or measuring resistors are therefore required to measure the current flowing through the at least one coil, with the result that it is possible in this case to minimise the circuit complexity considerably in comparison with the prior art. Since the pull-in and/or holding current through the coil of the voltage or current release is maintained or maintained at a constant value on account of the pulse-width modulation as a function of the supply voltage applied, it is no longer necessary to measure the current in this way using a shunt. The voltage over the holding or pull-in coil is thus held constant, with the result that the holding or pull-in current is constant. In contrast to EP 1 009 003 B1, no measuring devices are required to determine the current.

Advantageously, only one switch means is provided according to the invention between a supply input voltage source and the power supply apparatus. In particular, a switch means of this type is formed as a switching transistor, in particular as a self-locking field effect transistor, for example an n-channel MOSFET. This transistor is advantageously connected on the gate side to the pulse-width modulation device, connected on the drain side to the coil(s) which actuates (actuate) the voltage or current release and simultaneously serves (serve) as an impedor of the power supply apparatus acting as a power supply, and is connected on the source side with the other components of the power supply apparatus, in particular the diode blocking the flow of current in the reverse direction.

The power supply apparatus advantageously comprises at least one Zener diode operated in the reverse direction. This type of diode operated in the reverse direction is provided to generate a maximum value of the supply voltage, with the result that the first supply voltage can be generated via the rectifier diode at a capacitor of the power supply apparatus. It is possible for this first voltage to be supplied to the control unit and/or the pulse-width modulation device.

It is possible for at least one further storage capacitor to be provided in addition to the storage capacitor of the power supply apparatus which is advantageously connected in parallel with the Zener diode and, together with the rectifier diode, acts to provide a d.c. voltage as a first supply voltage. This further storage capacitor is advantageously connected in parallel with or connected downstream of the voltage regulation device for providing a further supply voltage. This makes it possible to provide at least one further supply voltage as a rectified voltage, the level of which can be adjusted by the voltage regulation device. This at least one further supply voltage may also be supplied to the control unit of the switching device or the pulse-width modulation device. The level of the first and further supply voltages is advantageously selected as a function of the required level of supply voltage, in particular for the control unit of the switching device or the pulse-width modulation device. One of the two supply voltages can be set at various levels depending on the application and can be adapted to application-specific requirements, via the voltage regulation device in particular.

The supply input voltage is initially applied to the power supply apparatus or the part of the switching device containing this apparatus. A connection is thus made through the switch means, in particular the aforementioned switching transistor, in the direction of the apparatus. It is now possible for at least two supply voltages for powering the switching device to be generated in this apparatus. The supply voltage generated in the apparatus is advantageously compared with a predefinable or predetermined threshold and, when the threshold is reached, a control unit triggering the pulse-width modulation operation and/or the pulse-width modulation device is activated by this supply voltage. This means that when the voltage within the apparatus reaches a first predefinable supply voltage threshold, this supply voltage is supplied to the control unit or the pulse-width modulation unit which then begins operation. In this case, the supply input voltage supplied is measured in the region of the control unit or the pulse-width modulation device in a predefinable or predetermined time interval and a current turn-on time of the pulse-width modulation is determined therefrom. In this way, the current turn-on time of the pulse-width modulation is determined on the basis of the measured value of the supply input voltage supplied to the control unit or the pulse-width modulation device in such a way that the coil voltage is held constant and therefore the current flowing through the coil is also held constant. The current flowing through the coil or coils is therefore held constant over the entire supply input voltage range. This constant voltage is used in turn by the power supply apparatus acting as a power supply, that is to say the power supply apparatus is in turn powered by this current which is constant over the entire supply input voltage range and produces therefrom further constant supply voltages at a predefinable level.

Figure 2:
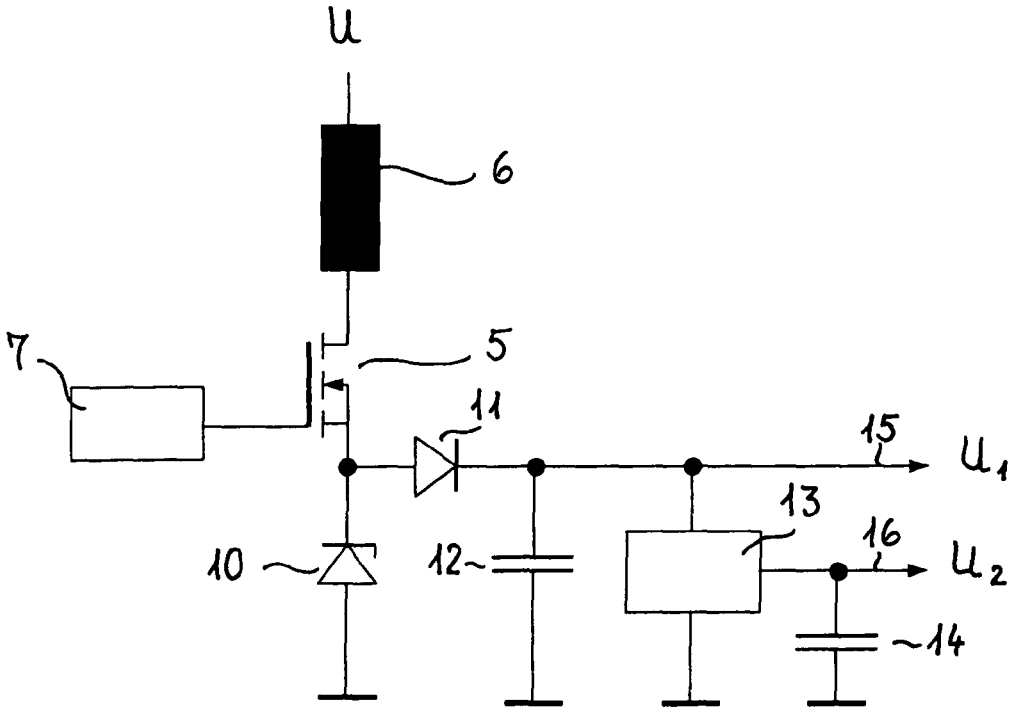
FIG. 2 is a schematic diagram of the detail showing the power supply apparatus, the coil and the pulse-width modulation device shown in FIG. 1.

FIG. 1 is a schematic diagram of the circuitry of part of a switching device which comprises a power supply apparatus 1, a control unit 2 with three voltage terminals 20, 21, 22, a voltage measuring means 3 and a filter and rectifier device 4. On the output side, the control unit is connected to a switch means in the form of a self-locking field effect transistor 5. In FIGS. 1 and 2 this transistor is formed as an n-channel MOSFET.

On the drain side, the field effect transistor 5 is connected to a coil 6. In a manner similar to the voltage measuring means 3, the coil is further connected to the filter and rectifier device 4. The filter and rectifier device 4 is connected to a supply input voltage U. Both the voltage measuring means 3 and the coil 6, which may be a pull-in coil or a holding coil or may be formed as two coils, namely a pull-in coil and a holding coil, or may be formed in two parts as a pull-in and holding coil, are provided with a filtered and rectified pulsating (a.c.) supply input voltage. The voltage measuring means 3 measures this filtered and rectified supply input voltage before it is supplied to the control unit 2 via the first voltage terminal 20. Other supply voltages, such as a 15V voltage and a 3.3V voltage, may be provided via the second and third voltage terminals 21, 22 as supply voltages for the control unit 2.

In this embodiment, a pulse-width modulation device 7 is provided inside the control unit. A device 8 for measuring the supply input voltage U is also provided. A new turn-on time for the pulse-width modulation is calculated using the respective supply input voltage value measured at that point in time. For this purpose, the control unit comprises for example a microcontroller which activates the pulse-width modulation device accordingly or carries out the pulse-width modulation operation.

Once this supply input voltage U is connected, a connection is made through the field effect transistor 5, allowing voltage to be generated within the power supply apparatus 1. This is shown more clearly in the detail view in FIG. 2.

FIG. 2 only shows the coil 6, the self-locking field effect transistor 5, the pulse-width modulation device 7 as well as a Zener diode 10, a rectifier diode 11, a first storage capacitor 12, a voltage regulation device 13 and a second storage capacitor 14. The latter components are connected in parallel and the Zener diode 10, the first and second storage capacitors 12, 14 and the voltage regulation device 13 are connected to earth. The power supply apparatus 1 further comprises two outputs 15, 16, to which two different supply voltages $U_1$ and $U_2$ are provided.

The Zener diode 10 is operated in the reverse direction and generates a maximum value of the supply voltage. The first supply voltage $U_1$, which is determined from the predefinable Zener value, i.e. the value of the Zener voltage, is rectified to form a d.c. voltage and provided at the first output 15 via the rectifier diode 11 and the first storage capacitor 12. A d.c. voltage is also provided as the second supply voltage $U_2$ at the second output 16 of the apparatus 1 via the voltage regulation device 13 and the second storage capacitor 14.

In a predetermined or predefinable time interval, the supply input voltage is measured by the device 8 for measuring the supply input voltage and a new turn-on time for the pulse-width modulation device 7 is calculated using the voltage value U measured at that moment in time. In this way, the current flowing through the coil 6 (pull-in and/or holding coil) is held constant over the entire permitted supply voltage range. At the same time, the power supply apparatus 1 is supplied with a current which is constant over the entire permitted supply input voltage range, since the current flowing through the coil is also used, as previously explained, for supplying power to the power supply apparatus 1. In this case, the coil 6 therefore acts as an impedor for the apparatus 1 for generating the power supply and for actuating a voltage or current release of the switching device (not shown).

In addition to the embodiments of a power supply apparatus described above and shown in the figures, many other embodiments are also possible in which pulse-width modulation is carried out, independently of the supply voltage applied, to maintain a pull-in and holding current of a pull-in or holding coil, and the coil through which the pull-in or holding current flows is also used as an impedor for the power supply apparatus within a voltage- or current-releasing switching device.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

LIST OF REFERENCE NUMERALS

1 power supply apparatus
2 control unit
3 voltage measuring means
4 filter and rectifier device
5 self-locking field effect transistor

6 coil
7 pulse-width modulation (PWM) device
8 supply voltage measuring device
10 Zener diode
11 rectifier diode
12 first storage capacitor
13 voltage regulation device
14 second storage capacitor
15 first output
16 second output
20 first voltage terminal
21 second voltage terminal
22 third voltage terminal
U supply input voltage
$U_1$ first supply voltage
$U_2$ second supply voltage

The invention claimed is:

1. A power supply for a voltage or current-releasing switching device including at least one coil for a voltage or current release, the power supply comprising:

an activation device configured to activate a switch device in a pulse-width modulated manner, the activation device being configured for setting current through a coil, wherein inductance of the coil functions as an impedor of a clocked power supply configured to provide, via a rectifier diode and a storage capacitor, a first supply voltage that is predefinable via a comparison value;

a voltage regulation device for providing at least one second supply voltage; and a measurement-resistor-free regulation device for setting the current through the coil.

2. The power supply according to claim 1, further comprising at least one voltage-limiting component configured to limit the first supply voltage.

3. The power supply according to claim 2, wherein the voltage-limiting component is a Zener diode operated in a reverse direction.

4. The power supply according to claim 1, further comprising at least one additional storage capacitor connected downstream of the voltage regulation device for providing the at least one second supply voltage.

5. The power supply according to claim 1, wherein the coil is a pull-in coil and a holding coil for actuating at least one of a voltage release and a current release.

6. The power supply according to claim 1, wherein the coil is one of a pull-in coil and a holding coil for actuating the one of the voltage and current release.

7. The power supply according to claim 1, wherein the switch device is connected between a source of a supply input voltage and the clocked power supply.

8. The power supply according to claim 7, wherein the switch device is a switching transistor.

9. The power supply according to claim 8, wherein the switching transistor is a self-locking field effect transistor.

10. A method for supplying power to a voltage or current-releasing switching device including at least one coil for a voltage or current release, the method comprising:

setting a first supply voltage by comparing the first supply voltage with a predefined value;

setting at least a second supply voltage by a voltage regulation device;

providing a clocked power supply wherein inductance of the at least one coil functions as an impedor thereof;

clocking current flowing in the at least one coil so as to generate the first and second supply voltages for the switching device and so as to set the current flowing in the coil; and maintaining the current flowing in the coil at a set value over a voltage range of a supply input voltage by pulse-width modulation.

11. The method according to claim 10, wherein maintaining the current includes measuring the supply input voltage in a predetermined time interval and determining a current turn-on time of the pulse-width modulation therefrom.

12. The method according to claim 11, wherein the current turn-on time of the pulse-width modulation is determined on the basis of a value measured for the supply input voltage supplied to one of a control unit and the pulse-width modulation device in such a way that the current flowing through the coil is held constant.

* * * * *